US007802769B1

(12) United States Patent
Lindsey

(10) Patent No.: US 7,802,769 B1
(45) Date of Patent: Sep. 28, 2010

(54) APPARATUS FOR EFFICIENTLY HANGING A FRAME ON A WALL IN A LEVEL MANNER

(76) Inventor: James Lindsey, 707 Grand Ave., Laramie, WY (US) 82070

( * ) Notice: Subject to any disclaimer, the term of this patent is extended or adjusted under 35 U.S.C. 154(b) by 464 days.

(21) Appl. No.: 11/689,428

(22) Filed: Mar. 21, 2007

Related U.S. Application Data

(60) Provisional application No. 60/745,455, filed on Apr. 24, 2006.

(51) Int. Cl.
*A47G 1/16* (2006.01)

(52) U.S. Cl. ..... 248/489; 248/475.1; 33/613

(58) Field of Classification Search ..... 248/489, 248/542, 544, 490, 475.1, 693, 317, 339, 248/304, 301, 303; 33/613, 371
See application file for complete search history.

(56) References Cited

U.S. PATENT DOCUMENTS 4,597,554 A * 7/1986 James ..... 248/542
4,883,247 A * 11/1989 Crandall ..... 248/542
5,221,064 A * 6/1993 Hodges ..... 248/59
5,471,760 A * 12/1995 Farris ..... 33/613
5,636,825 A * 6/1997 Pernas ..... 248/489
5,878,987 A * 3/1999 Hayde ..... 248/477
6,053,468 A * 4/2000 Francis ..... 248/475.1
6,185,831 B1 * 2/2001 Pluciennik ..... 33/613
6,286,802 B1 * 9/2001 Munson et al. ..... 248/475.1
6,286,803 B1 * 9/2001 Pellino et al. ..... 248/490
6,299,123 B1 * 10/2001 Hayde ..... 248/476
6,550,739 B1 * 4/2003 Brindisi ..... 248/476
6,557,813 B1 * 5/2003 Duggan ..... 248/476
6,719,260 B1 * 4/2004 Hart ..... 248/479
7,216,841 B2 * 5/2007 Dodig, Jr. ..... 248/475.1
7,441,729 B2 * 10/2008 Humber et al. ..... 248/58

* cited by examiner

*Primary Examiner*—Anita M King
(74) *Attorney, Agent, or Firm*—The Reilly Intellectual Property Law Firm, P.C.; Ellen Reilly; John E. Reilly

(57) ABSTRACT

The present system and method enable the efficient level hanging of a frame (e.g., picture frame) on a wall using a bubble level integrated into a level member. The level member is rotatably attached to a mounting member that is secured to a wall. The level member is additionally configured to receive a hook and hold member that is attached to a frame. The mounting member includes at least one mounting member mounting hole configured to receive a securing device for securing the mounting member to a wall. Additionally, the mounting member includes at least one mounting member tightening hole configured to receive a tightening device for adjustably securing the mounting member to a level member, wherein the tightening device does not secure the mounting member to the wall. Furthermore, the mounting member is configured to include a mounting member receiver for receiving a level member plate. The level member includes a level member plate configured to be received by the mounting member receiver and adjustably secured to the mounting member by the tightening device. The level member plate itself includes two elements: a level member tightening hole in the level member plate for receiving the tightening device; and a level configured to display a horizontal orientation of the level member. The level member also includes an interface for engaging the hook and hold to removably secure the frame to the wall in a level manner. The hook and hold includes at least one frame connector configured to secure the hook and hold member to a frame.

8 Claims, 4 Drawing Sheets

APPARATUS FOR EFFICIENTLY HANGING A FRAME ON A WALL IN A LEVEL MANNER

CROSS REFERENCE TO RELATED APPLICATION

Priority is claimed from U.S. Provisional Application 60/745,455 entitled System and Method for Efficiently Hanging a Frame on a Wall in a Level Manner filed Apr. 24, 2006, which is incorporated herein by reference.

DESCRIPTION

1. Field of the Invention

The invention relates generally to a system and method for efficiently hanging a frame on a wall in a level manner. Additionally, the present system and method enable the efficient level hanging of a frame on a wall using a bubble level integrated into a rotatable level member.

2. Background of the Invention

It is often desirable to hang a frame, such as a picture frame, in a level manner. To hang the frame level, a bubble level is often used to facilitate the positioning of nails or other securing devices on the wall. However, a bubble level may not always be accessible or convenient to use.

Furthermore, when a picture frame must be reoriented (e.g., the markings for the nails were incorrectly marked, the nails were improperly positioned, or the picture frame and/or ceiling is not level), then the nails must be removed and reinstalled to achieve a desirable hang orientation. This problem may be further complicated because it may be undesirable to create multiple holes in close proximity, as this may weaken/crack a wall, and also complicates repair if the picture is later moved.

These and other drawbacks exist with other systems that prevent other systems from readily hanging frames efficiently in a desired orientation (e.g., level and/or parallel to a ceiling).

SUMMARY OF THE INVENTION

An object of the present invention is to overcome these and other drawbacks in existing systems and methods.

Another object of the present invention is to provide a system and method for hanging a picture frame in a level manner by using a bubble hanger that is rotatable with respect to a mounting member that is secured to a wall.

Other features and advantages of the invention will be apparent to one of ordinary skill in the art upon reviewing the detailed description of the invention.

DETAILED DESCRIPTION

The present apparatus enables the efficient level hanging of a frame (e.g. picture frame) on a wall using a bubble level 2*b* integrated into a level member 2. The level member 2 is rotatably attached to a mounting member 1 that is secured to a wall. The level member 2 is additionally configured to receive a hook and hold member 3 that is attached to a frame. The mounting member 1 includes at least one mounting member mounting hole 1*a*, 1*b* configured to receive a securing device for securing the mounting member 1 to a wall. Additionally, the mounting member 1 includes at least one mounting member tightening hole, or limiting receiver, 1*c* configured to receive a tightening device for adjustably securing the mounting member 1 to a level member 2, wherein the tightening device does not secure the mounting member 1 to the wall.

Furthermore, the mounting member 1 is configured to include a mounting member receiver, or a level member receiver, 1*d* for receiving a level member plate 2*a*. The level member 2 includes a level member plate 2*a* configured to be received by the mounting member receiver 1*d* and adjustably secured to the mounting member by the tightening device. The level member plate 2*a* itself includes two elements: a level member tightening hole, or an adjustment receiver, 2*c* in the level member plate for receiving the tightening device; and a level 2*b* configured to display a horizontal orientation of the level member 2. The level member 2 also includes an interface for engaging the hook and hold member 3 to removably secure the frame to the wall in a level manner. The hook and hold member 3 includes at least one frame connector 3*b*, 3*c* configured to secure the hook and hold member 3 to a frame.

Each of these elements will now be described in greater detail with respect to the relevant drawings.

Figure 1:
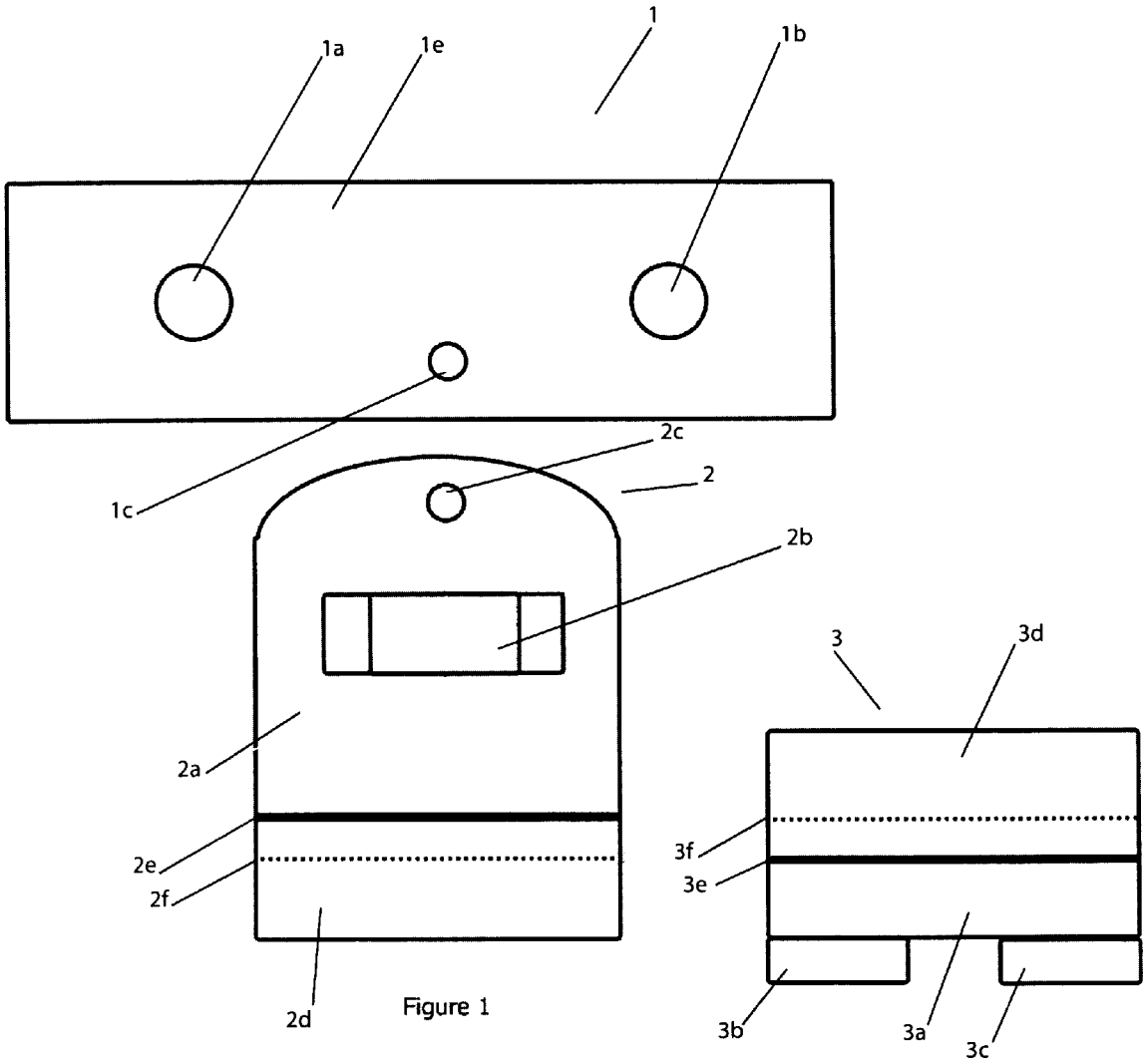
FIG. 1 is a frontal view of the present invention wherein the three members are separate.

FIG. 1 is a frontal view of the present invention wherein the three members are separate. Mounting member 1 is configured to be secured to a wall (not shown) and to receive level member 2. Mounting member 1 includes left and right mounting member mounting holes 1*a*, 1*b* and mounting member tightening hole 1*c*. Left and right mounting member mounting holes 1*a*, 1*b* go through the entire depth of the mounting member, and are configured to receive appropriate devices, S, for securing the mounting member 1 to a wall, such as screws, nails, or other devices. Mounting member tightening hole 1*c*, on the other hand, is configured to receive a tightening device, T, and is not configured to secure mounting member 1 to a wall. Because mounting member tightening hole 1*c* does not go through the entire depth of the mounting member, a tightening device can be repeatedly tightened and loosened without harming a wall (whereas repeatedly applying screws or nails to the mounting member mounting holes 1*a*, 1*b* would likely weaken a wall or cause other harm to the wall). It is understood that any number of mounting member holes and tightening member holes could be used, and changes could be made to the number described herein without departing from the spirit of the present invention.

Level member 2 includes level member plate 2*a*, level 2*b*, level member tightening hole 2*c*, level member interlocking piece 2*d*, level member interlocking lip 2*e*, and level member receiver 2*f*. Each of these elements is described in greater detail below.

Level member plate 2*a* is a flat plate through which a level member tightening hole 2*c* is formed and on which level 2*b* and level member interlocking piece 2*d* are attached. Level 2*b* can be any type of level, and is preferably a bubble level. It may be attached to level member plate 2*a* by any conventional means, including forming a level receiving cavity within level member plate 2*a* and securing the level in the cavity, building a retaining structure around level 2*b* and gluing the retaining structure directly to the level member plate 2*a*, and other means. Similarly, the level member interlocking piece 2*d* may be formed as an integral part of the level member plate 2*a*, glued to level member plate 2*a* or attached by other means.

Figure 3:
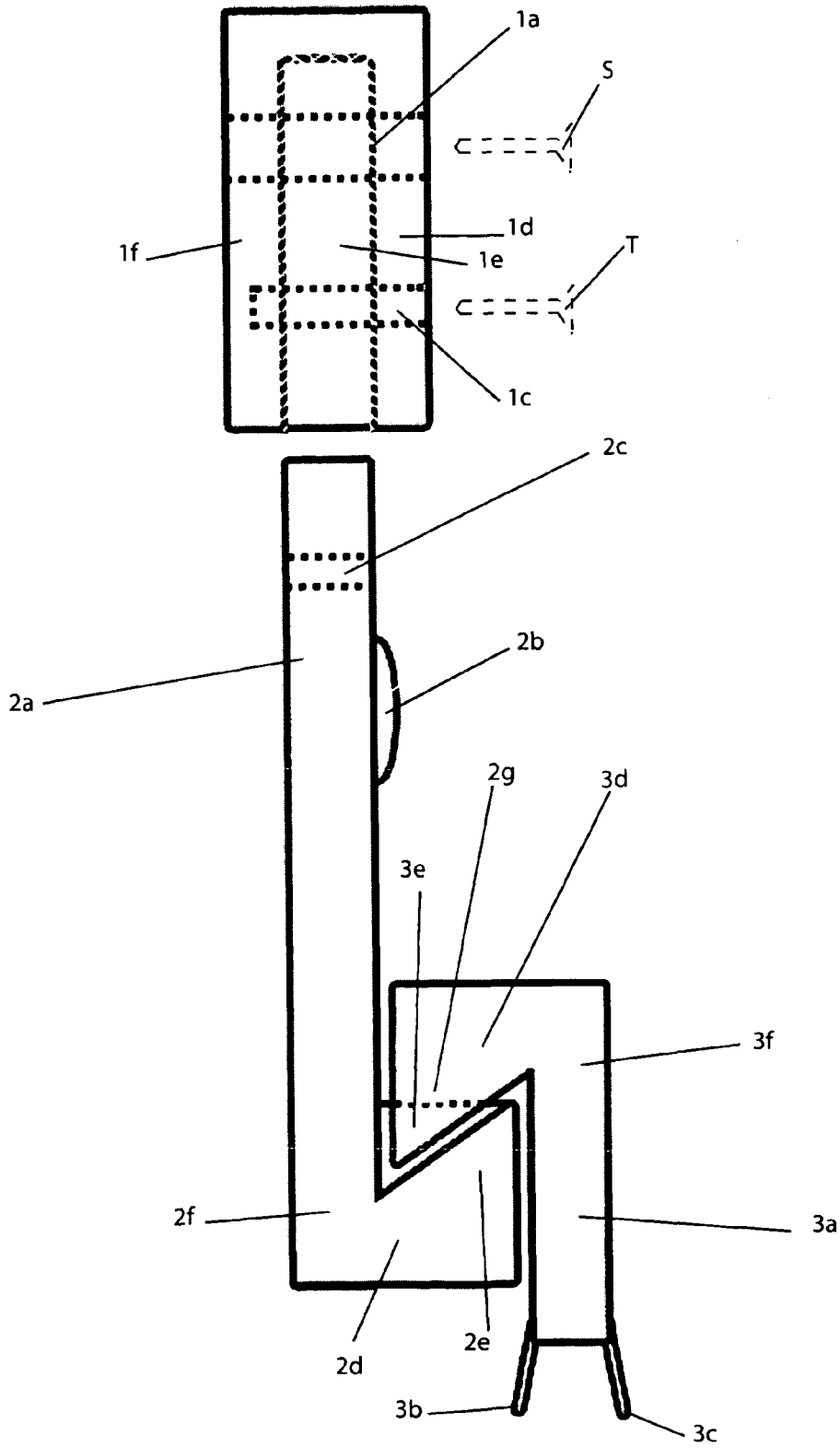
FIG. 3 is a side view of the present invention wherein the three members are depicted proximate to their assembled positions.

Level member interlocking piece 2*d* includes level member interlocking lip 2*e* and level member receiver 2*f*. Level member interlocking lip 2*e* is configured to engage hook and hold member receiver 3*f*, and level member receiver 2*f* is configured to engage hook and hold interlocking lip 3*e*. The manner in which the interlocking pieces engage one another is depicted in FIG. 3. As can be seen on FIG. 1, level member interlocking lip 2*e* obstructs the direct view of level member receiver 2*f* and level member receiver 2*f* is depicted with a dashed line.

FIG. 1 shows the front face of the hook and hold member 3. To engage level member 2 and hook and hold member 3, hook and hold member 3 must be flipped horizontally to enable the interlocking pieces 2*d*, 3*d* to properly engage, as described in greater detail with respect to FIG. 3. The hook and hold member 3 includes a hook and hold plate 3*a*, left and right wire holders 3*b*, 3*c*, hook and hold interlocking piece 3*d*, hook and hold interlocking lip 3*e*, and hook and hold receiver 3*f*. Hook and hold plate 3*a* is a flat plate to which left and right wire holders 3*b*, 3*c* and hook and hold interlocking piece 3*d* are attached. The hook and hold interlocking piece 3*d* may be formed as an integral part of the hook and hold plate 3*a*, glued to hook and hold plate 3*a* or attached by other means.

Hook and hold interlocking piece 3*d* includes hook and hold interlocking lip 3*e* and hook and hold receiver 3*f*. Hook and hold interlocking lip 3*e* is configured to engage level member receiver 2*f*, and hook and hold receiver 3*f* is configured to engage level member interlocking lip 2*e*. As can be seen on FIG. 1, hook and hold interlocking lip 3*e* obstructs the direct view of hook and hold receiver 3*f* and hook and hold receiver 3*f* is depicted with a dashed line.

Figure 2:
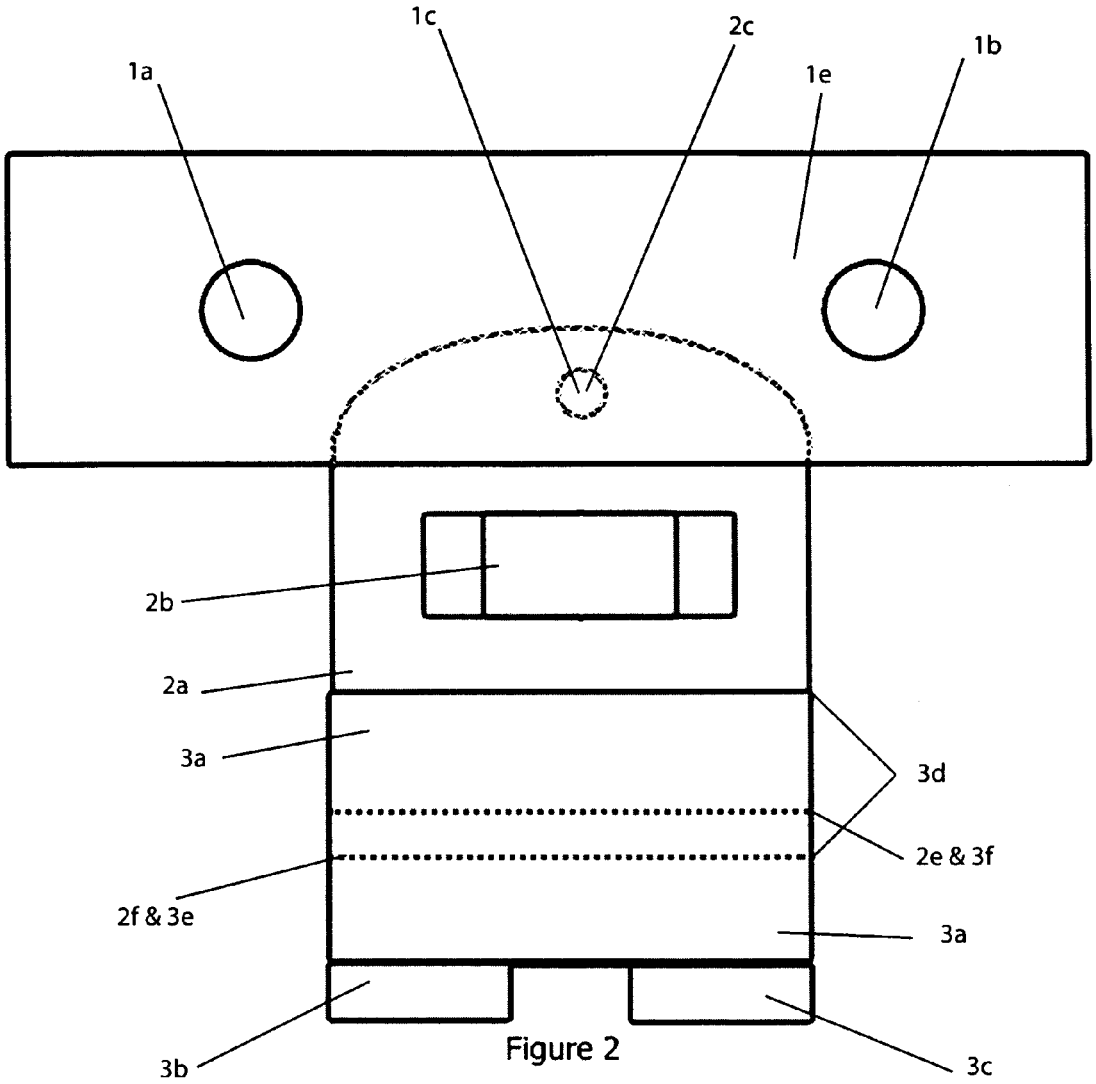
FIG. 2 is a frontal view of the present invention wherein the three members are assembled.

FIG. 2 is a frontal view of the present invention wherein the three members are assembled. As depicted, level member 2 is rotatably secured to mounting member 1 by inserting level member plate 2*a* into mounting member receiver 1*d*, aligning mounting member tightening hole 1*c* and level member tightening hold 2*c*, and inserting a tightening device. In a preferred embodiment, an anchored screw serves as the tightening device, and this anchored screw is permanently attached at the time of manufacture.

FIG. 2 also depicts the mounting member and level member interlocking pieces 2*d*, 3*d* in an engaged state. Level member interlocking lip 2*e* is engaged with hook and hold receiver 3*f* and level member receiver 2*f* is engaged with hook and hold interlocking lip 3*e*. Level member retaining wall 2*g* is on the right side of level member 2 if it is used.

FIG. 3 is a side view of the present invention wherein the three members are depicted proximate to their assembled positions. As shown, left and right mounting member mounting hole 1*a*, 1*b* go through the entire depth of mounting member 1, thereby enabling screws, nails, or other securing devices to secure the mounting member 1 to a wall. Mounting member tightening hole 1*c*, on the other hand, does not go through the entire depth of mounting member 1, thereby enabling repeated tightening and loosening of a tightening device. By enabling repeated tightening and loosening of the tightening device, the angular orientation of level member 2 with respect to mounting member 1 can be repeatedly adjusted without harming the wall on which the mounting member is secured.

Level member plate 2*a* is positioned directly below mounting member receiver 1*d*. As stated above, in a preferred embodiment level member 2 is inserted into mounting member 1 and an anchored screw is secured through tightening holes 1*c*, 2*c*. Level member interlocking lip 2*e* is engaged with hook and hold receiver 3*f* and level member receiver 2*f* is engaged with hook and hold interlocking lip 3*e*.

Level member retaining wall 2*g*, the direct view of which is partially obstructed by hook and hold interlocking piece 3*d*, may be used to serve as a retaining wall, such that while hook and hold member 3 is being engaged with level member 1, the operator can slide the hook and hold member 3 until it comes into contact with the level member retaining wall 2*g*. In this way, the picture frame may be positioned in the same horizontal position. Additionally, using the level member retaining wall 2*g* ensures that there is maximum contact between the interlocking pieces 2*d*, 3*d*.

The hook and hold member 3 additionally includes a hook and hold plate 3*a* that is connected to hook and hold interlocking piece 3*d* and at least one frame connector 3*b*, 3*c*. The frame connector 3*b*, 3*c* is configured to secure the hook and hold member to a frame. This may be done by any conventional manner, including crimping metallic retainers around a wire attached to the picture frame or any other method that securely engages the hook and hold member to a picture frame.

Figure 4:
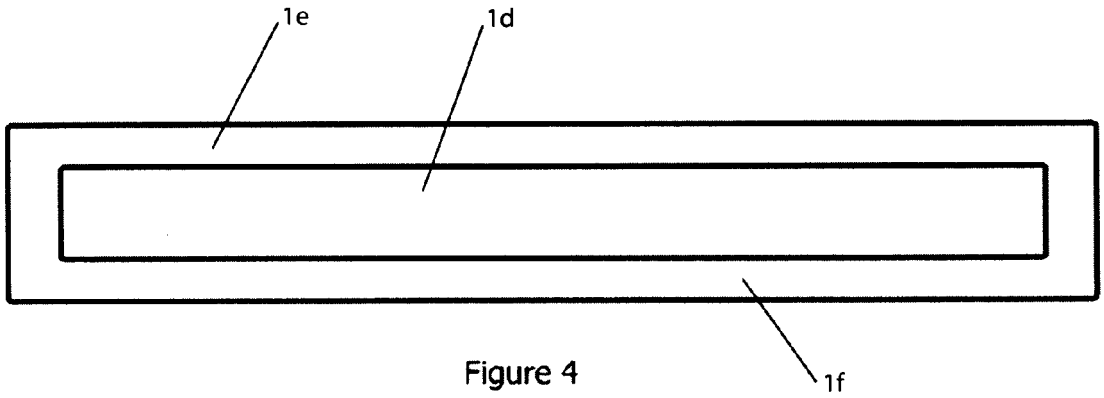
FIG. 4 is a bottom view of the mounting member that depicts the mounting member receiver.

FIG. 4 is a bottom view of the mounting member that depicts the mounting member receiver. Shown are the mounting member receiver 1*d*, mounting member frame face 1*e*, and the mounting member wall face 1*f*.

Mounting member receiver 1*d* is configured to receive level member plate 2*a*. Preferably, mounting member receiver 1*d* is configured to enable rotation of level member 2 with respect to the tightening holes 1*c*, 2*c*. Specifically, mounting member receiver 1*d* is wide enough to provide several degrees of rotation of level member 2. For example, mounting member 1*d* may have a width 10%, 50%, or more greater than the width of level member plate 2*a*. Additionally, the depth of mounting member receiver 1*d* (e.g., the distance between mounting member frame face 1*e* and the mounting member wall face 1*f*) must be sufficient to receive and allow translation of level member plate 2*a* while at the same time enabling a tightening device to selectively secure the orientation of mounting member 1 and level member 2 with respect to each other by friction when the tightening device is tightened.

Although the present invention is described as having a single mounting member tightening hole 1*c*, other designs could be implemented without departing from the scope of the present invention. For example, level member plate 2 may be configured with multiple holes, and mounting member 1 could be configured with mounting member tightening tracks (not shown) to increase the amount of friction possible between the members.

Other embodiments of the invention will be apparent to those skilled in the art from consideration of the specification and practice of the invention disclosed herein. The specification and examples should be considered exemplary only. The scope of the invention is only limited by the claims appended hereto.

1—Mounting Member
- 1*a*/1*b*—Left/Right Mounting Member Mounting Hole
- 1*c*—Mounting Member Tightening Hole
- 1*d*—Mounting Member Receiver
- 1*e*—Mounting Member Frame Face
- 1*f*—Mounting Member Wall Face

2—Level Member
- 2*a*—Level Member Plate
- 2*b*—Level
- 2*c*—Level Member Tightening Hole
- 2*d*—Level Member Interlocking Piece
- 2*e*—Level Member Interlocking Lip

2*f*—Level Member Receiver
2*g*—Level Member Retaining Wall
3—Hook and Hold Member
3*a*—Hook and Hold Plate
3*b*/3*c*—Left/Right Wire Holders
3*d*—Hook and Hold Interlocking Piece
3*e*—Hook and Hold Interlocking Lip
3*f*—Hook and Hold Receiver

What is claimed:

1. A device for efficiently hanging a frame on a wall in a level manner, said device comprising:

a mounting member having at least one mounting member mounting hole configured to receive a securing device for securing the mounting member to a wall, at least one mounting member tightening hole configured to receive a tightening device for adjustably securing the mounting member to a level member, wherein said tightening device does not secure the mounting member to the wall and a mounting member receiver configured to receive a level member plate;

a level member having the level member plate configured to be received by the mounting member receiver and adjustably secured to the mounting member by the tightening device, said level member plate having a level member tightening hole in the level member plate for receiving the tightening device;

a level configured to display a horizontal orientation of the level member;

a level member interlocking piece attached to the level member plate having a level member receiver configured to receive a hook and hold interlocking lip and a level member interlocking lip configured to be received by a hook and hold receiver;

a hook and hold member having a hook and hold plate;

at least one frame connector configured to secure the hook and hold member to the frame, said at least one frame connector attached to the hook and hold plate; and a hook and hold member interlocking piece attached to the hook and hold plate having the hook and hold interlocking receiver configured to receive the level member interlocking lip; and the hook and hold interlocking lip configured to be received by the level member receiver.

2. A device for efficiently hanging a frame on a wall in a level manner, said device comprising:

a wall mounting member having at least one mounting member tightening hole;

a mounting member receiver configured to receive a level member plate;

a level member defined by the level member plate having a level member tightening hole in the level member plate that corresponds to said mounting member tightening hole;

a level configured to display a horizontal orientation of the level member; and a hook and hold member configured to engage with the level member and a frame connector.

3. The device of claim 2, wherein the wall mounting member further includes:

at least one mounting member mounting hole configured to receive a securing device for securing the mounting member to a wall.

4. The device of claim 2, wherein the mounting member tightening hole is configured to receive a tightening device for adjustably securing the mounting member to said level member.

5. The device of claim 2, wherein said level member plate is configured to be received by the mounting member receiver and adjustably secured to the mounting member by the tightening device.

6. The device of claim 2, wherein said level member comprises:

a level member interlocking piece attached to the level member plate comprising:

a level member receiver configured to receive a hook and hold interlocking lip; and a level member interlocking lip configured to be received by a hook and hold receiver.

7. The device of claim 6, wherein the hook and hold member includes:

a hook and hold plate;

at least one frame connector configured to secure the hook and hold member to a frame, said at least one frame connector attached to the hook and hold plate; and a hook and hold member interlocking piece attached to the hook and hold plate.

8. The device of claim 7, wherein the hook and hold member interlocking piece comprises:

the hook and hold receiver configured to receive the level member interlocking lip; and the hook and hold interlocking lip configured to be received by the level member receiver.

* * * * *